US007472428B2

(12) United States Patent
Van Atta et al.

(10) Patent No.: US 7,472,428 B2
(45) Date of Patent: Jan. 6, 2009

(54) SWIM CAP WITH MULTIPLE DUROMETERS

(75) Inventors: Dylan S. Van Atta, Portland, OR (US); Robert Bruce, Portland, OR (US)

(73) Assignee: Nike, Inc., Beaverton, OR (US)

( * ) Notice: Subject to any disclaimer, the term of this patent is extended or adjusted under 35 U.S.C. 154(b) by 375 days.

(21) Appl. No.: 10/814,594

(22) Filed: Mar. 30, 2004

(65) Prior Publication Data

US 2005/0217003 A1 Oct. 6, 2005

(51) Int. Cl.
*A42B 1/12* (2006.01)

(52) U.S. Cl. ..... 2/68; 2/200.2

(58) Field of Classification Search ..... 2/68, 2/200.2, 174, 410, 411, 414, 909, DIG. 11
See application file for complete search history.

(56) References Cited

U.S. PATENT DOCUMENTS

| | | | | | |
|---|---|---|---|---|---|
| 1,516,380 | A * | 11/1924 | Eaton | 2/68 |
| 2,295,659 | A * | 9/1942 | Howland | 2/68 |
| 2,324,735 | A * | 7/1943 | Spanel | 2/68 |
| 2,515,554 | A * | 7/1950 | Freeman | 2/68 |
| 2,520,048 | A * | 8/1950 | Moore | 2/68 |
| 2,664,569 | A * | 1/1954 | Andrews | 2/68 |
| 3,321,772 | A * | 5/1967 | Arps et al. | 2/68 |
| 3,979,777 | A * | 9/1976 | Gregg | 2/68 |
| 4,134,155 | A * | 1/1979 | Robertson | 2/412 |
| 4,937,888 | A * | 7/1990 | Straus | 2/411 |
| 5,095,545 | A | 3/1992 | Lane | 2/68 |
| 5,537,667 | A * | 7/1996 | Kenning et al. | 381/386 |
| 5,734,990 | A | 4/1998 | Waring | 2/69 |
| 5,790,988 | A * | 8/1998 | Guadagnino et al. | 2/411 |
| 5,887,280 | A | 3/1999 | Waring | 2/69 |
| 6,052,825 | A * | 4/2000 | Dodd | 2/68 |
| 6,237,162 | B1 * | 5/2001 | Gill | 2/422 |
| 6,256,799 | B1 * | 7/2001 | McGlasson et al. | 2/422 |
| 6,966,068 | B2 * | 11/2005 | Johnson et al. | 2/68 |
| 2002/0133866 | A1 * | 9/2002 | Lee | 2/200.1 |
| 2002/0184699 | A1 * | 12/2002 | Ewing et al. | 2/412 |

FOREIGN PATENT DOCUMENTS

| | | |
|---|---|---|
| EP | 0 813 372 | 11/2000 |
| WO | WO 96/28052 | 9/1996 |

OTHER PUBLICATIONS

"Swimmer . . . or Technology: Part II, or That's Using His Cap"; PhillipWhitten; Swiminfo; Jul. 19, 2004; 3 pgs.

* cited by examiner

*Primary Examiner*—Katherine Moran
(74) *Attorney, Agent, or Firm*—Banner & Witcoff, Ltd

(57) ABSTRACT

A swim cap includes a first portion configured to cover at least a portion of a crown of a user's head and having a first durometer. A second portion of the swim cap is secured to the first portion and has a second durometer, with the second durometer being smaller than the first durometer.

23 Claims, 4 Drawing Sheets

SWIM CAP WITH MULTIPLE DUROMETERS

FIELD OF THE INVENTION

This invention relates generally to a swim cap, and, in particular, to a swim cap having multiple durometers.

BACKGROUND OF THE INVENTION

Swim caps are well known for covering the head of a swimmer, and serve to reduce water resistance by enclosing the swimmer's hair within a tight thin flexible skin that envelopes the upper portion of the wearer's skull. Known swim caps are typically formed of a soft, flexible material with a hardness, or durometer hardness (commonly referred to as "durometer"), that is very low. This allows the cap to be stretched tightly over the swimmer's head. Typical materials used to form such swim caps are latex and silicone. Swim caps may also have designs or logos on their exterior surface, thereby providing aesthetic appeal and/or advertising.

It is an object of the present invention to provide a swim cap that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a swim cap having a first portion with a first durometer and a second portion with a second durometer that is smaller than the first durometer. The first portion is thus stiffer and harder than the second portion.

In accordance with a first aspect, a swim cap includes a first portion configured to cover at least a portion of a crown of a user's head and having a first durometer. A second portion is secured to the first portion and has a second durometer, which is smaller than the first durometer.

In accordance with another aspect, a swim cap includes a first portion configured to cover at least portion of a crown of a user's head and having a first durometer. A second portion is secured to the first portion and has a second durometer, which is smaller than the first durometer. A surface discontinuity is formed on an exterior surface of one of the first portion and second portion.

In accordance with a further aspect, a swim cap includes a first portion configured to cover at least a portion of a crown of a user's head and having a first durometer. A second portion is secured to the first portion and has a second durometer, which is smaller than the first durometer. The second portion is configured to be stretched over a user's head. A plurality of projections is disposed on an exterior surface of one of the first portion and second portion.

Substantial advantage is achieved by providing a swim cap having multiple durometers. In particular, the higher durometer first portion serves to break the surface of the water and resists deformation. The lower durometer second portion acts to reliably secure the swim cap to the user's head.

These and additional features and advantages of the invention disclosed here will be further understood from the following detailed disclosure of certain preferred embodiments.

Figure 1:
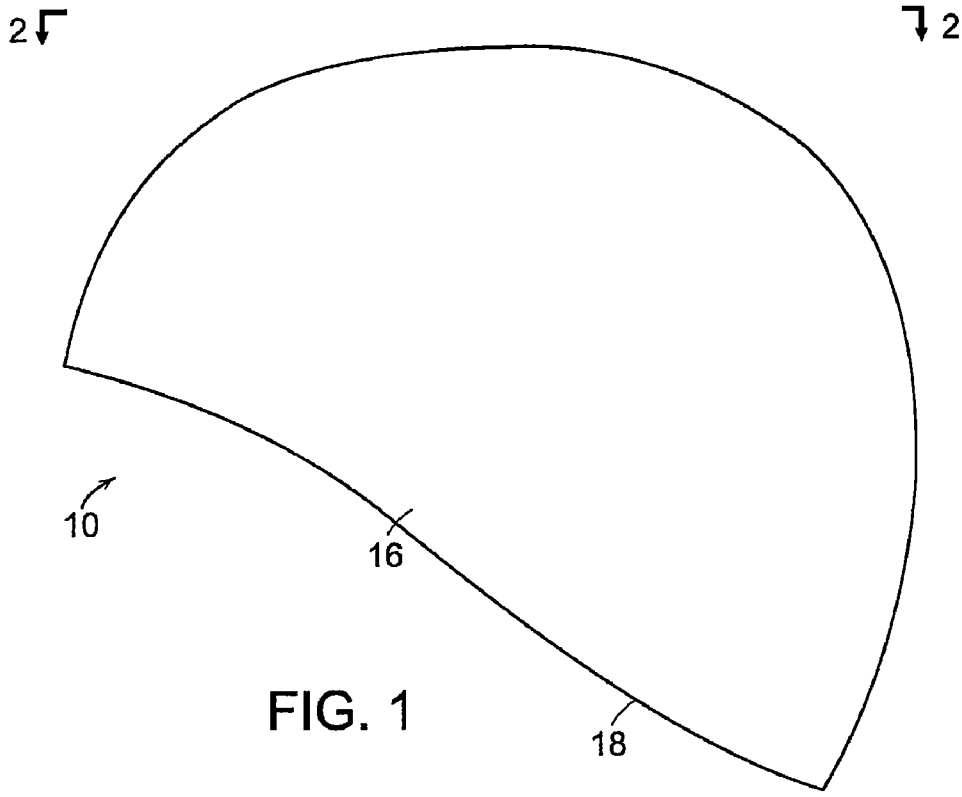
FIG. 1 is an elevation view of a swim cap in accordance with a preferred embodiment of the present invention.

The figures referred to above are not drawn necessarily to scale and should be understood to present a representation of the invention, illustrative of the principles involved. Some features of the swim cap having multiple durometers depicted in the drawings have been enlarged or distorted relative to others to facilitate explanation and understanding. The same reference numbers are used in the drawings for similar or identical components and features shown in various alternative embodiments. Swim caps having multiple durometers as disclosed herein, would have configurations and components determined, in part, by the intended application and environment in which they are used.

DETAILED DESCRIPTION OF CERTAIN PREFERRED EMBODIMENTS

Figure 2:
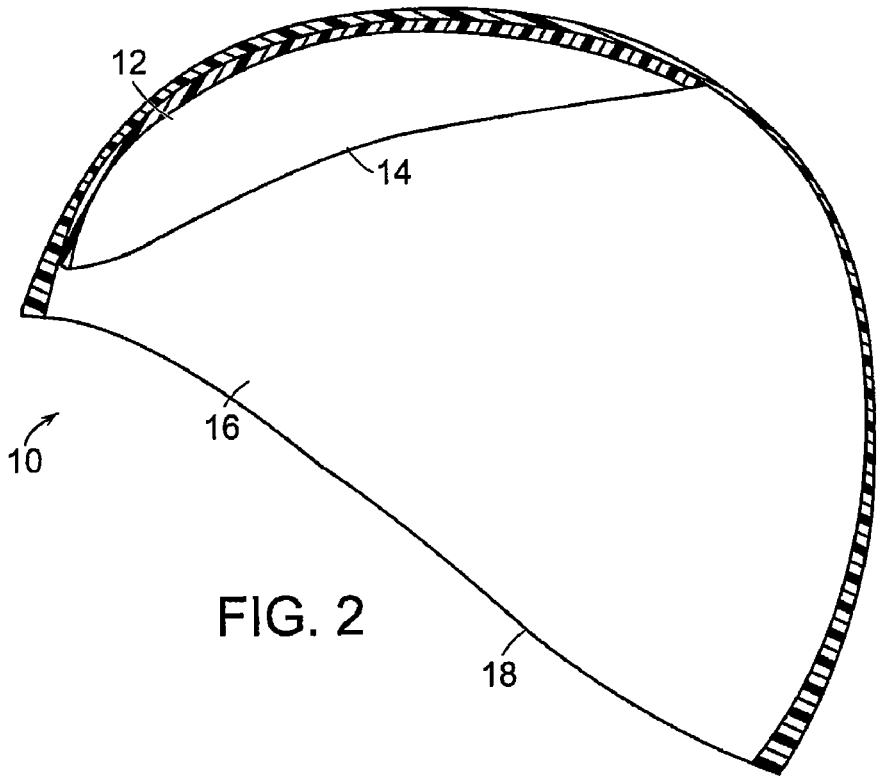
FIG. 2 is a section view of the swim cap of FIG. 1, taken along line 2-2 of FIG. 1.

The present invention may be embodied in various forms. A preferred embodiment of a swim cap 10 is shown in FIGS. 1-2. Swim cap 10 is formed of a first portion 12 that is configured to cover at least a portion of the crown of the user's head and has a peripheral edge 14. In the illustrated embodiment, first portion 12 is substantially dome shaped, and is configured to cover a forward portion of the crown of the user's head. The specific size and shape of first portion 12 as well as its position with respect to the user's head can be varied to accommodate many different head sizes and shapes.

A second portion 16 is positioned on an exterior surface of first portion 12 and extends beyond peripheral edge 14 a desired distance so as to be able to cover a substantial portion of the user's head. In a preferred embodiment, second portion 16 extends far enough to substantially cover the portion of a user's head from which their hair grows, with a rear portion extending downwardly further than a front portion so that a peripheral edge 18 of second portion 16 generally follows the user's hairline.

First portion 12 preferably has a hardness, or durometer that is higher than the durometer of second portion 16. Thus, first portion 12 is harder, or stiffer, than second portion 16. Although the extent to which first portion 12 covers the top of the user's head may vary, by positioning the stiffer first portion 12 at the crown or top of the user's skull, first portion 12 acts to break through the surface of the water as the user's head moves through the water. The stiffness of first portion 12 also advantageously resists deformation, thereby maintaining its smooth configuration in spite of movement by the user.

First portion 12 may be formed of glycolised polyethylene terephthalate polyester (PETg), silicone, or any other relatively stiff pliable material. Other suitable materials will become readily apparent to those skilled in the art, given the benefit of this disclosure.

Second portion 16 is preferably formed of a soft, flexible, stretchy material, which serves to conform to the user's head and provide the tension necessary to keep swim cap 10 tight on the user's head. Second portion 16 may be formed of silicone, latex, or any other relatively soft, flexible, stretchy material. Other suitable materials for second portion 16 will become readily apparent to those skilled in the art, given the benefit of this disclosure.

In certain preferred embodiments, second portion 16 is bonded to first portion 12. Second portion 16 may be bonded to first portion 12 during a molding process. In other embodiments, second portion 16 may be bonded to first portion 12 with an adhesive or epoxy. Suitable adhesives or epoxies will become readily apparent to those skilled in the art, given the benefit of this disclosure.

In certain embodiments, first portion 12 has a thickness of approximately 1 mm, while second portion 16 has a thickness of approximately 0.5 mm in the region where it extends over first portion 12 and gradually thickens toward peripheral edge 18, where its thickness is approximately 2 mm.

Figure 3:
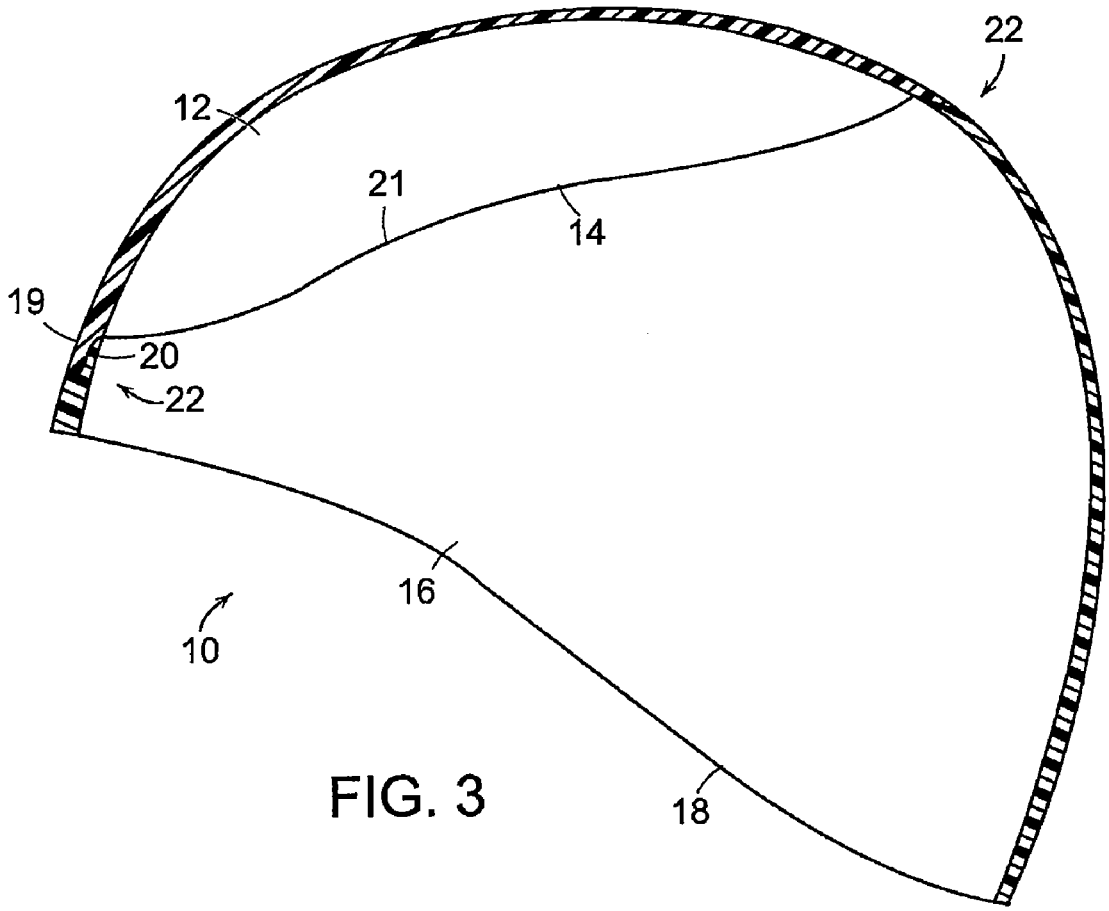
FIG. 3 is a section view of an alternative embodiment of a swim cap in accordance with the present invention.
Figure 4:
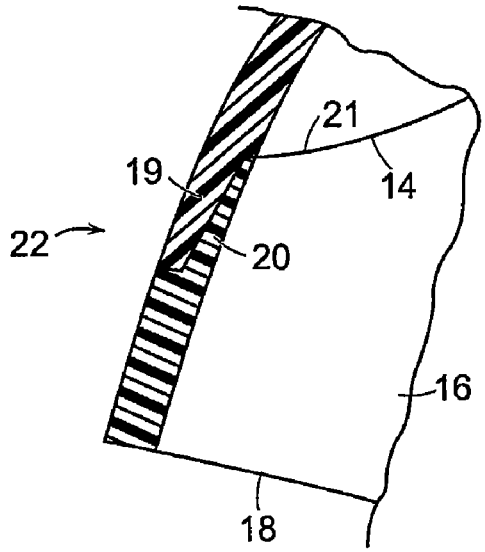
FIG. 4 is an enlarged view of a portion of the swim cap of FIG. 3, showing the overlap between a first portion and a second portion of the swim cap.

Another embodiment of swim cap 10 is shown in FIGS.3-4, which second portion 16 does not extend over first portion 12. Rather, in this embodiment, second portion 16 has an annular shape, and is secured about peripheral edge 14 of first portion 12. Specifically, as seen more clearly in FIG. 4, a flange 19 formed along peripheral edge 14 of first portion 12 overlaps a flange 20 formed along an inner peripheral edge 21 of second portion 16 so as to form a lap joint 22. In certain embodiments, lap joint 22 may be formed by co-molding swim cap 10 in a double injection molding process. In the fist step, the material of first portion 12 is injected, and in the second step, the material of second portion 16 is injected. Flanges 19 and 20 could also be bonded together by way of an adhesive.

In this embodiment, first portion 12 has a thickness of approximately 1 mm. Second portion 16 has a thickness of approximately 1 mm along inner peripheral edge 21, and gradually thickens toward its outer peripheral edge 18, where its thickness is approximately 2 mm.

Figure 5:
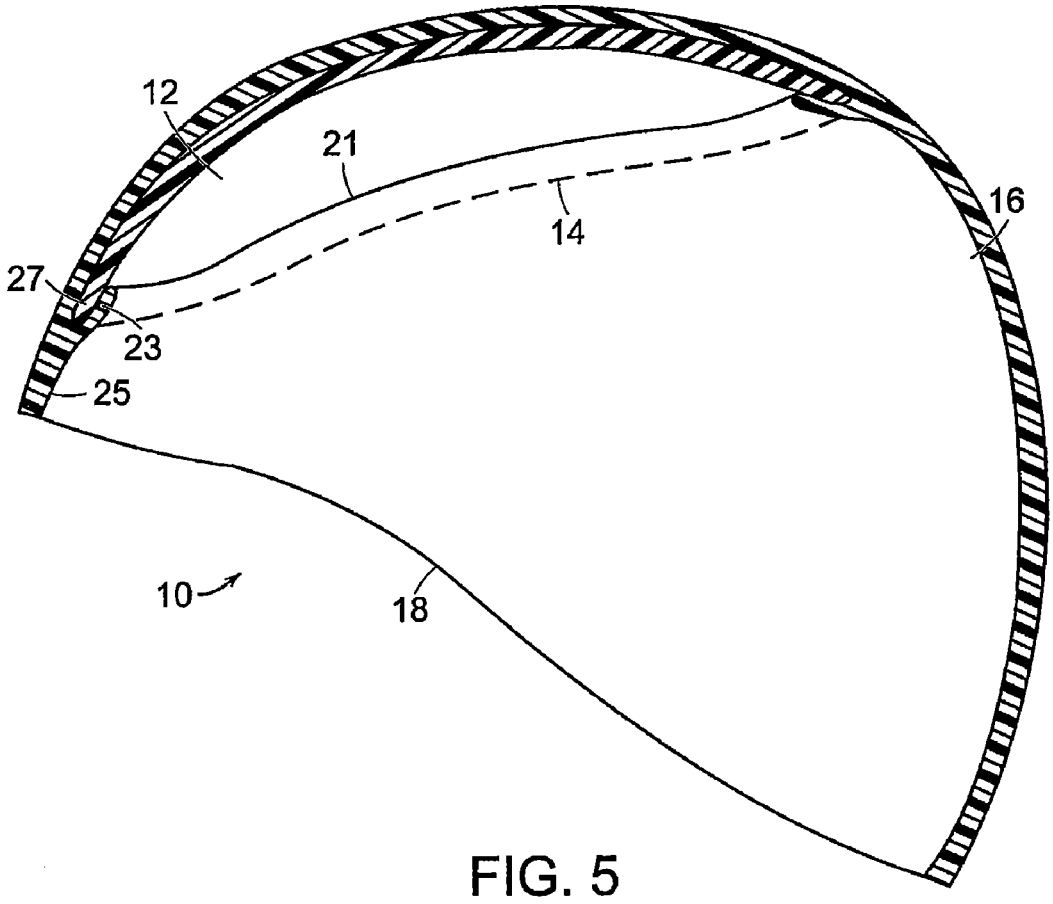
FIG. 5 is a section view of another alternative embodiment of a swim cap in accordance with the present invention.
Figure 6:
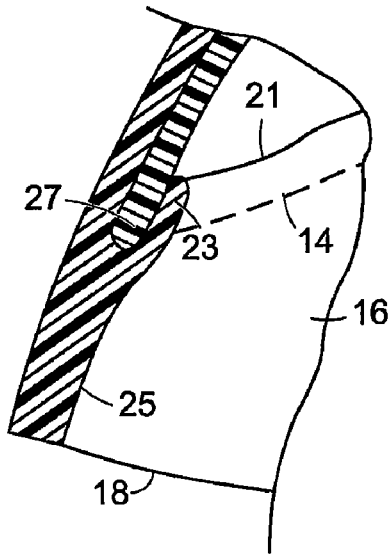
FIG. 6 is an enlarged view of a portion of the swim cap of FIG. 5, showing the overlap between a first portion and a second portion of the swim cap.

Another embodiment of swim cap 10 is shown in FIGS. 5-6. In this embodiment second portion 16 extends over first portion 12. A flange 23 is formed on an interior surface 25 of second portion 16 and serves to retain a peripheral edge 27 of first portion 12. To assemble swim cap 10, second portion 16 is stretched over first portion 12 such that flange 23 passes by peripheral edge 27 of first portion 12. Second portion 16 is then released and snaps back such that peripheral edge 27 is nested behind flange 23 and first portion 12 is resiliently securely to second portion 16.

Figure 7:
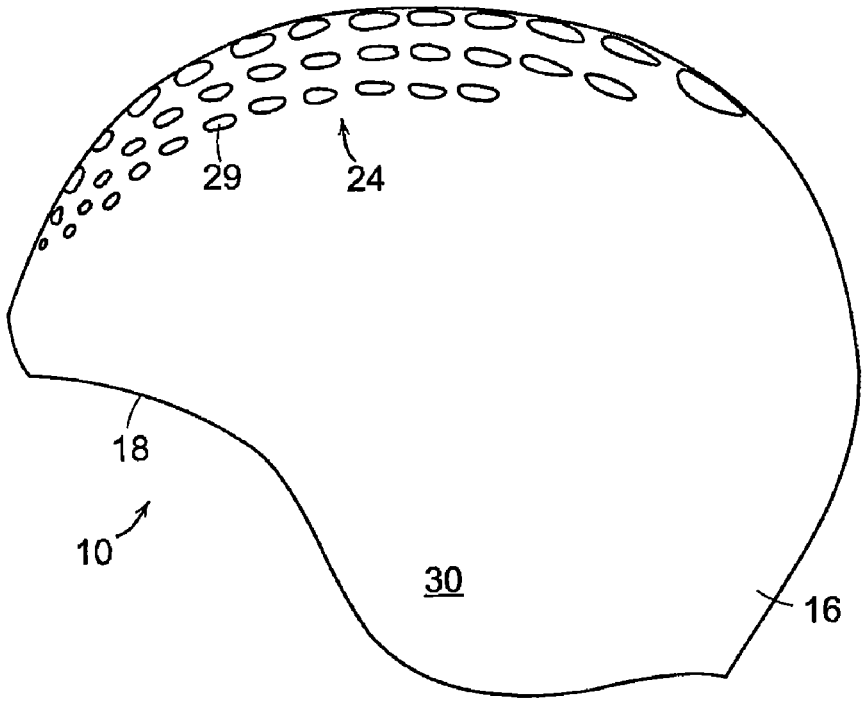
FIG. 7 is an elevation view of another embodiment of a swim cap in accordance with the present invention, including a surface discontinuity on the exterior surface of the swim cap.

Another embodiment is shown in FIG. 7, in which a surface discontinuity 24 is formed on the exterior surface of swim cap 10. Surface discontinuity 24 serves to reduce laminar flow across swim cap 10, thereby improving the flow of water over the surface of swim cap 10.

Surface discontinuity 24 may comprise any element with a surface that extends above or below the exterior surface of swim cap. Thus, surface discontinuity 24 may comprise ridges, bumps, texture, or any other element with a surface that extends above the exterior surface of swim cap 10. Alternatively, surface discontinuity 24 may be formed of a plurality of recesses, dimples, indentations, grooves, depressions, or other elements with a surface that extends below the exterior surface of swim cap 10. It is to be appreciated that surface discontinuity 24 may comprise any combination of projections and recesses, that is, any combination of elements with a surface that extends above the exterior surface of swim cap 10 and elements with a surface that extends below the exterior surface of swim cap 10. In this embodiment, surface discontinuity 24 comprises a plurality of projections 26 on the exterior surface of second portion 16.

It is to be appreciated that in certain preferred embodiments, surface discontinuity 24 may be formed on the exterior surface of first portion 12. In embodiments where second portion 16 is positioned outward of and stretched over first portion 12, surface discontinuity 24 projects outwardly from the exterior surface of first portion 12 against second portion 16, pushing second portion 16 outwardly in the areas where projections 26 are formed.

In another embodiment, as illustrated seen in FIG. 7, surface discontinuity 24 comprises a plurality of substantially oval projections 29. Although projections 29 are oval in the illustrated embodiment, it is to be appreciated that the projections may have any desired shape.

FIG. 7 also illustrates another preferred embodiment, in which swim cap 10 is provided with an extension portion 30 along outer peripheral edge 18 on both sides of swim cap 10. Extension portions 20 serve to substantially cover the user's ears.

Figure 8:
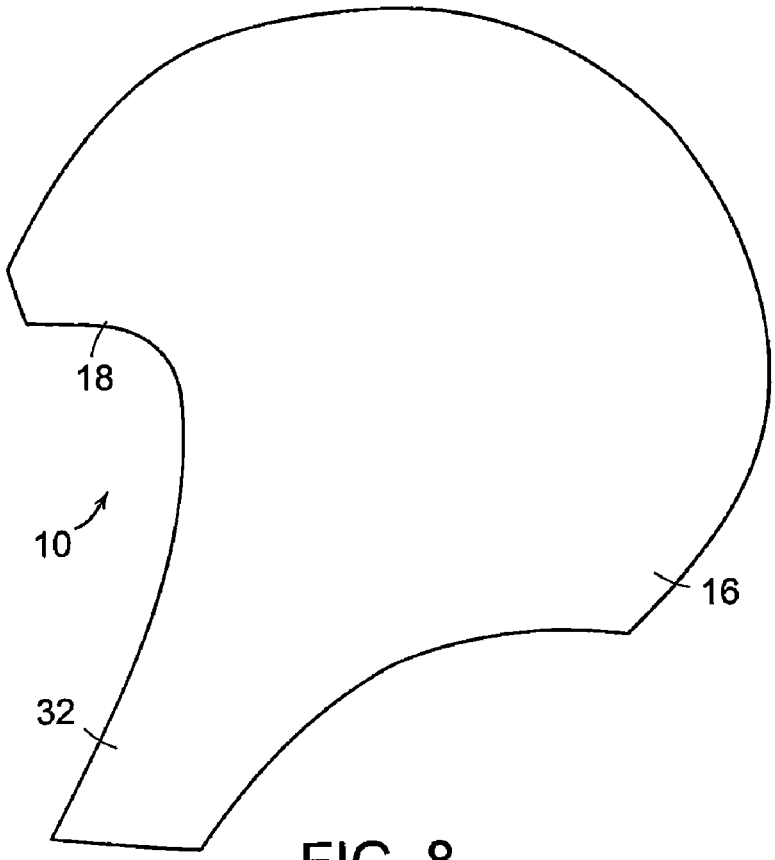
FIG. 8 is an elevation view of yet another alternative embodiment of a swim cap in accordance with the present invention.

Another embodiment is illustrated in FIG. 8, in which a chin strap 32 extends from peripheral edge 18 on one side of swim cap 10 to peripheral edge 18 on the opposite side of swim cap 10. Chin strap 32 extends beneath the user's chin when swim cap 10 is placed on the user's head, and serves to further ensure that swim cap 10 remains tightly secured to the user's head.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A swim cap comprising, in combination:

a first portion configured to cover at least a portion of a crown of a user's head and having a first durometer; and a second portion formed of a flexible and stretchy material configured to conform tightly to and provide tension to keep the cap tight on a user's head, secured to the first portion and having a second durometer, the second durometer being smaller than the first durometer, the second portion configured to be in contact with and cover a substantial portion of a user's head during use.

2. The swim cap of claim 1, wherein a portion of the second portion overlays the first portion.

3. The swim cap of claim 1, wherein an outer peripheral portion of the second portion has a thickness greater than a thickness of its inner portion.

4. The swim cap of claim 1, wherein the second portion entirely covers the first portion and extends beyond a peripheral edge of the first portion.

5. The swim cap of claim 1, wherein the first portion is substantially dome-shaped and the second portion has an annular shape, a peripheral edge of the first portion being secured to an inner peripheral edge of the second portion.

6. The swim cap of claim 5, wherein the peripheral edge of the first portion and the inner peripheral edge of the second portion are secured to one another in an overlapping manner.

7. The swim cap of claim 5, further comprising a flange on the peripheral edge of the first portion, and a flange on the inner peripheral edge of the second portion secured to the flange on the first portion.

8. The swim cap of claim 5, wherein the peripheral edge of the first portion is bonded to the inner peripheral edge of the second portion.

9. The swim cap of claim 1, further comprising a surface discontinuity on an exterior surface of one of the first portion and the second portion.

10. The swim cap of claim 9, wherein the surface discontinuity is found on an exterior surface of the first portion.

11. The swim cap of claim 9, wherein the surface discontinuity is found on an exterior surface of the second portion.

12. The swim cap of claim 9, wherein the surface discontinuity comprises a plurality of projections.

13. The swim cap of claim 12, wherein the plurality of projections are substantially dome-shaped.

14. The swim cap of claim 9, wherein the surface discontinuity comprises a plurality of recesses.

15. The swim cap of claim 9, wherein the surface discontinuity comprises at least one projection and at least one recess.

16. The swim cap of claim 1, further comprising a flange formed on an interior surface of the second portion, a peripheral edge of the first portion positioned between the flange and the interior surface of the second portion.

17. The swim cap of claim 16, wherein the second portion is stretched over the first portion such that the first portion and second portion are resiliently secured together by the flange.

18. The swim cap of claim 1, wherein the first portion is formed of PETg.

19. The swim cap of claim 1, wherein the first portion is formed of silicone.

20. The swim cap of claim 1, wherein the second portion is formed of silicone.

21. The swim cap of claim 1, wherein the second portion is formed of latex.

22. The swim cap of claim 1, further comprising a pair of opposed extension portions extending from a peripheral edge of the second portion, each extension portion configured to substantially cover an ear of a user.

23. The swim cap of claim 1, further comprising a chin strap on the second portion configured to extend beneath a user's chin, the chin strap having first and second ends secured to a peripheral edge of the second portion.

* * * * *